US011162270B2

(12) United States Patent
Zittmayr

(10) Patent No.: US 11,162,270 B2
(45) Date of Patent: Nov. 2, 2021

(54) BUILDING COMPLEX

(71) Applicant: Johannes Zittmayr, Enns (AT)

(72) Inventor: Johannes Zittmayr, Enns (AT)

( * ) Notice: Subject to any disclaimer, the term of this patent is extended or adjusted under 35 U.S.C. 154(b) by 198 days.

(21) Appl. No.: 16/490,030

(22) PCT Filed: Nov. 30, 2017

(86) PCT No.: PCT/AT2017/050027
§ 371 (c)(1),
(2) Date: Aug. 29, 2019

(87) PCT Pub. No.: WO2018/165681
PCT Pub. Date: Sep. 20, 2018

(65) Prior Publication Data

US 2021/0254356 A1 Aug. 19, 2021

(30) Foreign Application Priority Data

Mar. 17, 2017 (AT) ..... A50212/2017

(51) Int. Cl.
*E04H 1/00* (2006.01)
*E04B 1/00* (2006.01)

(52) U.S. Cl.
CPC ..... *E04H 1/005* (2013.01); *E04B 2001/0084* (2013.01)

(58) Field of Classification Search
CPC ..... E04H 1/005; E04B 2001/0053–0092
See application file for complete search history.

(56) References Cited

U.S. PATENT DOCUMENTS 3,331,168 A 7/1967 Frey
3,342,008 A * 9/1967 Frey ..... E04B 1/3404 52/745.04

(Continued)

FOREIGN PATENT DOCUMENTS

CN 102758558 A 10/2012
DE 9420394 U1 * 3/1995 ..... E04H 1/1205

(Continued)

OTHER PUBLICATIONS

Espacenet English-language Abstract for CN 102758558 A, Oct. 31, 2012.

*Primary Examiner* — Adriana Figueroa
(74) *Attorney, Agent, or Firm* — Tiajoloff & Kelly LLP

(57) ABSTRACT

A building complex consisting of multi-storey ring-shaped buildings (R) is described, said ring-shaped buildings having sectors (1) which are trapezoidal in plan view, form a regular polygon ring and enclose a courtyard having a central stairwell (4), the storeys (3) of said sectors being uniformly offset from one another in the height direction and being connected to the stairwell (4) by passages (5) which run in a spoke-like fashion, said stairwell having a staircase which circulates in the direction of ascent of the storeys and which has a height of ascent (a) between the passages (5) corresponding to the storey offset (h). In order to connect the individual ring-shaped buildings (R) to one another, it is proposed that, in the case of ring-shaped buildings (R) comprising an even-numbered polygon ring, the mutually identical ring-shaped buildings (R) are arranged at the vertices of a polygon corresponding to the polygon ring and, in the case of ring-shaped buildings (R) comprising an odd-numbered polygon ring, said ring-shaped buildings are arranged in an alternating fashion, in each case offset through an angle of 180°, at the vertices of a polygon having twice the number of vertices, and that the ring-shaped (Continued)

Figure 1:
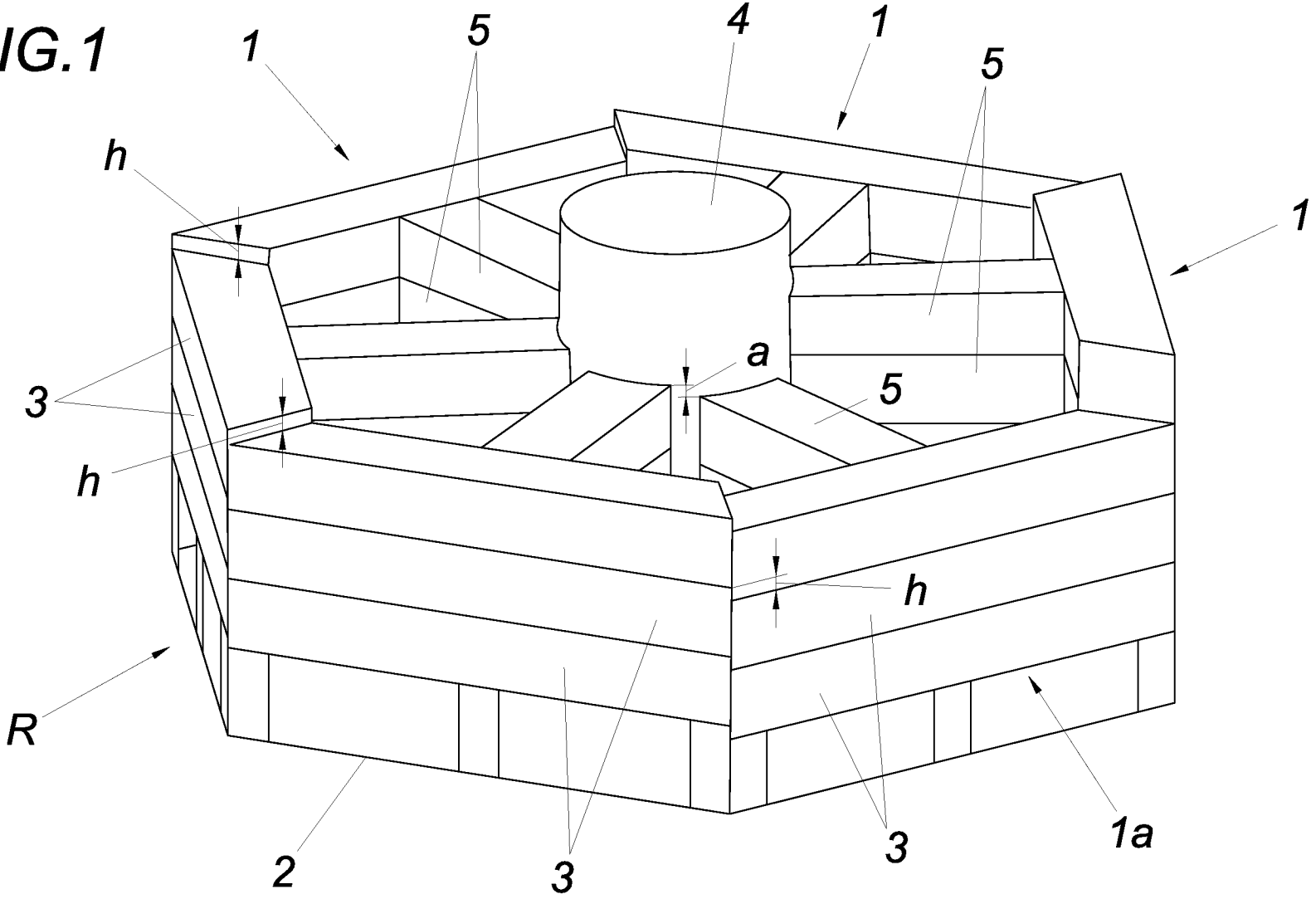

buildings (R) following one another along the polygon are connected by passages (6) which run between the storeys (3) of the mutually opposite connecting sectors with a corresponding storey offset.

6 Claims, 4 Drawing Sheets

(56) References Cited

U.S. PATENT DOCUMENTS

| | | | | |
|---|---|---|---|---|
| 3,395,502 | A * | 8/1968 | Frey | E04B 1/34823 52/73 |
| 5,377,465 | A * | 1/1995 | Kobori | E04B 1/3404 52/236.3 |
| 6,279,277 | B1 | 8/2001 | Zittmayr | |
| 10,059,568 | B2 | 8/2018 | Yuksel | |
| 10,480,175 | B2 * | 11/2019 | Furlanetto | E04B 1/3404 |
| 2016/0257531 | A1 | 9/2016 | Yuksel | |

FOREIGN PATENT DOCUMENTS

| | | | | |
|---|---|---|---|---|
| DE | 29716674 | U1 * | 10/1997 | E04B 1/3412 |
| DE | 19917302 | A1 * | 10/2000 | E04H 1/02 |
| DE | 202016002565 | U1 | 5/2016 | |
| GB | 149441 | A * | 8/1920 | E04H 1/02 |
| WO | WO-9218725 | A1 * | 10/1992 | E04B 1/3404 |
| WO | 98/041715 | A1 | 9/1998 | |
| WO | 2016/141058 | A1 | 9/2016 | |

* cited by examiner

BUILDING COMPLEX

TECHNICAL FIELD

The invention relates to a building complex consisting of multi-storey ring-shaped buildings having sectors which are trapezoidal in plan view, form a regular polygon ring and enclose a courtyard having a central stairwell, the storeys of said sectors being uniformly offset from one another in the height direction and being connected to the stairwell by passages which run in a spoke-like fashion, said stairwell having a staircase which circulates in the direction of ascent of the storeys and which has a height of ascent between the passages corresponding to the storey offset.

PRIOR ART

In order to be able to use one stairwell which is common to all sectors and storeys to easily move around within a ring-shaped building in the form of a regular polygon ring having sectors which form storeys offset from one another in the height direction, it is known (WO 1998/041715 A1) to provide a central stairwell within the courtyard enclosed by the polygon ring, said central stairwell being connected to the individual storeys of each sector by a respective spoke-like passage. Since the stairwell has a staircase which circulates in the direction of ascent of the storeys and which has a height of ascent between the passages corresponding to the storey offset, then despite the storey offset between the individual sectors any storey can be reached from any storey, wherein in each case only the height difference between the respective storeys has to be overcome. Within the ring-shaped building, therefore, sectors are obtained which are delimited from one another in the height direction and which enable the ring-shaped building to be advantageously divided using simple structural means, without having to dispense with a storey-by-storey connection between the sectors, which do not require their own stairwells for this purpose. If multiple ring-shaped buildings of this type are constructed, the advantages of these ring-shaped buildings can be utilized in each case per se, but it would be advantageous to connect these ring-shaped buildings to one another in such a way that the advantages achieved for the individual ring-shaped buildings can be extended to a building complex consisting of multiple such ring-shaped buildings.

SUMMARY OF THE INVENTION

The problem addressed by the invention is therefore that of forming, in the case of a building complex consisting of a plurality of polygonal ring-shaped buildings, a connection between the individual ring-shaped buildings so that it is possible to walk from ring-shaped building to ring-shaped building without having to use the central stairwells to exit and enter the individual ring-shaped buildings.

Proceeding from a building complex of the type outlined in the introduction, the invention solves the stated problem in that, in the case of ring-shaped buildings comprising an even-numbered polygon ring, the mutually identical ring-shaped buildings are arranged at the vertices of a polygon corresponding to the polygon ring and, in the case of ring-shaped buildings comprising an odd-numbered polygon ring, said ring-shaped buildings are arranged in an alternating fashion, in each case offset through an angle of 180°, at the vertices of a polygon having twice the number of vertices, and in that the ring-shaped buildings following one another along the polygon are connected by passages which run between the storeys of the mutually opposite connecting sectors with a corresponding storey offset, wherein, between the two connecting sectors of each ring-shaped building, there is a number of sectors which in the case of an even-numbered polygon ring corresponds to half the number of vertices minus two and in the case of an odd-numbered polygon ring corresponds to half the number of vertices plus one, minus two.

As a result of these measures, the situation is achieved whereby the mutually opposite connecting sectors of directly successive ring-shaped buildings not only run parallel to one another but also have a corresponding storey offset, so that the mutually corresponding storeys of said connecting sectors can easily be connected to one another by passages. It is thus possible to pass from one storey of a connecting sector of one ring-shaped building directly into the corresponding storey of the connecting sector of the ring-shaped building that is adjacent in the course of the polygon arrangement.

Although the number of vertices of the polygonal ring-shaped buildings can be selected differently, preference is generally given to ring-shaped buildings which have six or five vertices. Ring-shaped buildings which form a regular hexagon are thus arranged at the vertices of a hexagon, whereas, in the case of ring-shaped buildings in the shape of a pentagon, the buildings have to be arranged at the vertices of a decagon.

BRIEF DESCRIPTION OF THE INVENTION

Figure 2:
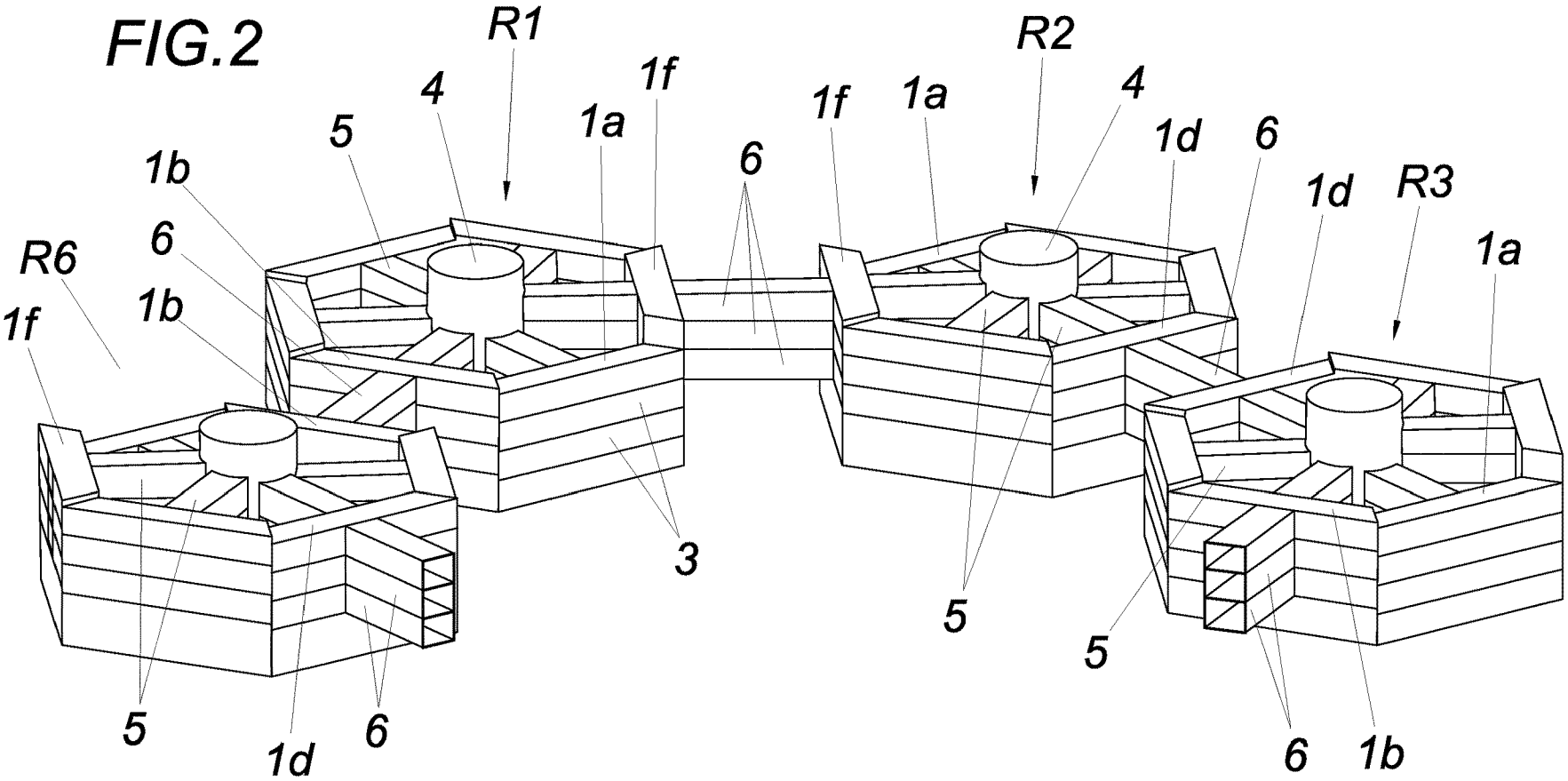
Figure 3:
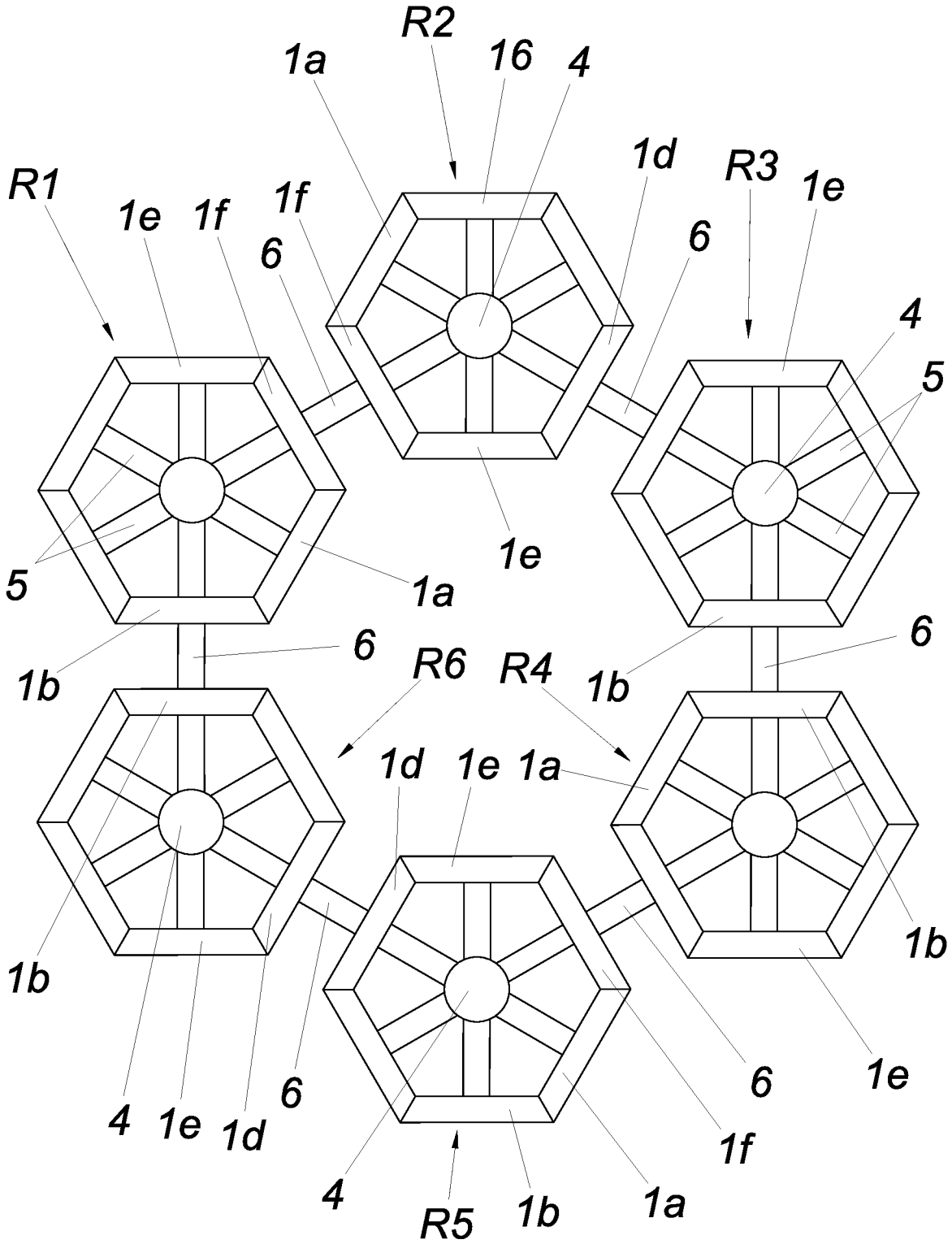
Figure 4:
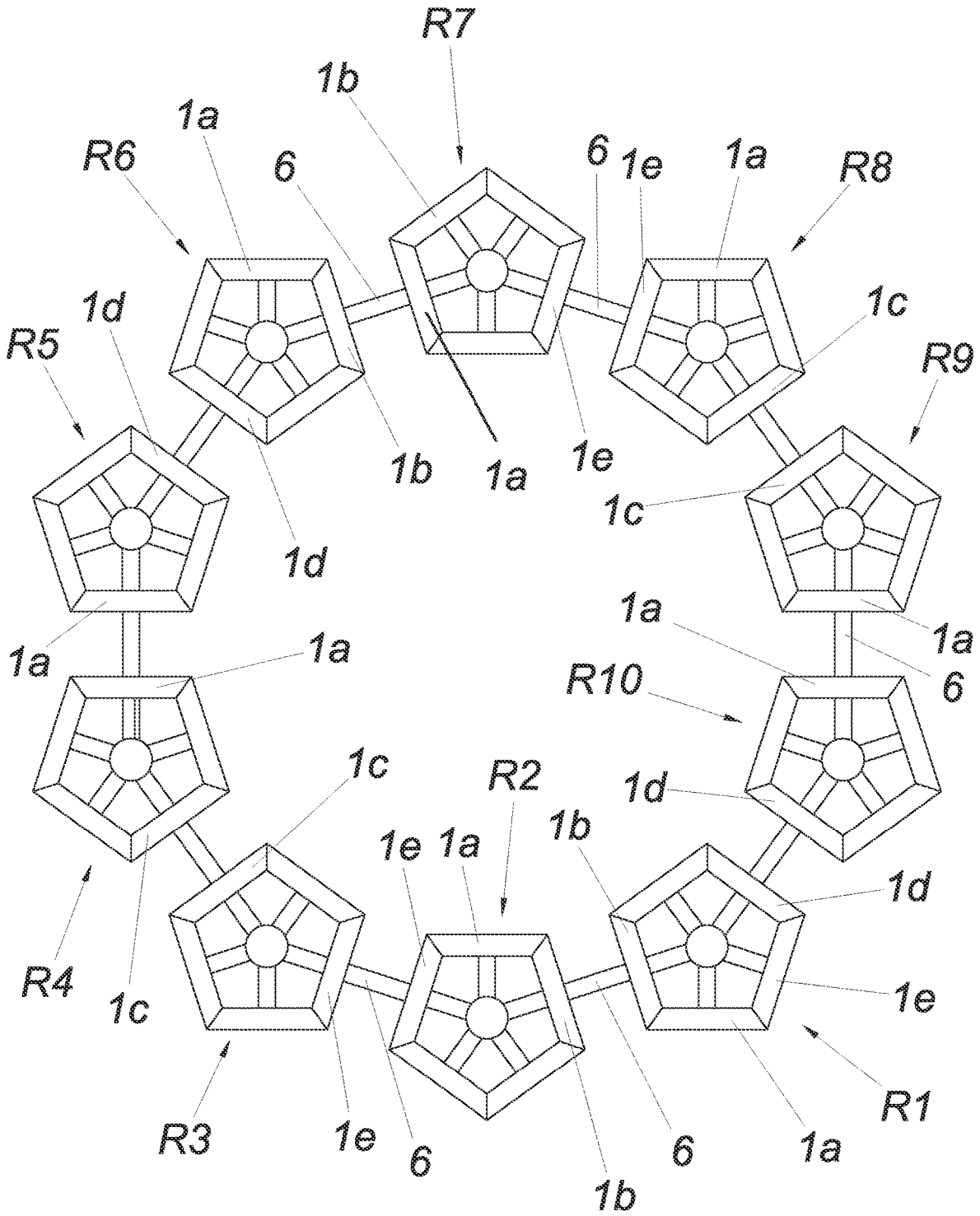

The subject matter of the invention is shown by way of example in the drawing, in which FIG. 1 shows one ring-shaped building of a building complex according to the invention, FIG. 2 shows a schematic detail view of a building complex according to the invention, FIG. 3 shows the building complex according to FIG. 1 in a simplified plan view, and FIG. 4 shows a design variant of a building complex according to the invention in a schematic plan view.

WAY OF IMPLEMENTING THE INVENTION

A ring-shaped building R for a building complex according to the invention comprises, as shown in FIG. 1, a regular polygon ring formed of sectors 1 which are trapezoidal in plan view and which comprise storeys 3 constructed on a foundation 2. Starting with a sector 1*a*, the storeys 3 of the individual sectors 1 are uniformly offset from one another in the height direction by a storey offset h. A central stairwell 4 is arranged within the courtyard of the ring-shaped building R that is enclosed by the polygon ring formed of the sectors 1, said central stairwell being connected to the individual storeys 3 of the sectors 1 by spoke-like passages 5. The stairwell 4 forms a staircase which circulates in the direction of ascent of the storeys and which has a height of ascent a between the passages 5 corresponding to the storey offset h. The individual storeys 3 of each sector 1 can thus be reached via the central stairwell 4 and are connected to one another by the latter, without having to provide a stairwell assigned to the individual sectors 1.

In order to be able to link such polygonal ring-shaped buildings R to one another to form a building complex, the ring-shaped buildings R are arranged at the vertices of a polygon, the number of vertices of which depends on the number of vertices of the polygonal ring-shaped buildings R. A distinction must be made here between ring-shaped buildings R comprising an even-numbered polygon ring and ring-shaped buildings R comprising an odd-numbered polygon ring. While ring-shaped buildings R comprising an even-numbered polygon ring can be arranged at the vertices of a polygon having the same number of vertices, ring-shaped buildings R comprising an odd-numbered polygon ring have to be provided at the vertices of a polygon having a number of vertices that corresponds to twice the number of vertices of the polygon ring. This is due to the fact that, in the case of even-numbered polygon rings, the sectors 1 are in each case located diametrically opposite one another in pairs, but in the case of odd-numbered polygon rings a sector 1 is in each case located diametrically opposite a vertex of the polygon, which, if the ring-shaped buildings R are arranged in an alternating fashion offset through an angle of 180°, leads to the situation whereby, for ring-shaped buildings R in the shape of an odd-numbered polygon ring, the ring-shaped buildings R must be arranged along a polygon having twice the number of vertices.

FIGS. 2 and 3 show a building complex for six hexagonal ring-shaped buildings R1 to R6. The central stairwells 4 of the six ring-shaped buildings R1 to R6 brought together to form a building complex thus form a regular hexagon, as can be seen in particular in FIG. 3. The arrangement here is such that in each case two sectors 1 with a corresponding storey offset are located opposite one another, so that these connecting sectors can easily be connected to one other, storey-by-storey, by means of passages 6. Assuming that the sector 1 with the lowest storeys 3 is denoted by the additional reference sign a and the sectors 1 following thereafter in the direction of ascent of the storeys are successively denoted by reference signs b to f, the sectors 1*f* of the consecutive ring-shaped buildings R1 and R2 are located parallel to one another when the consecutive ring-shaped buildings R1 to R6 assume a position rotated through 180° in an alternating fashion around the central stairwell 4. The storeys 3 of the mutually opposite sectors 1*f* of the two ring-shaped buildings R1 and R2, which sectors correspond to one another in terms of the storey offset, can thus easily be connected to one another by passages 6. Due to the rotational positions of the ring-shaped buildings R2 and R3, the sectors 1*d* of said ring-shaped buildings R2 and R3 form the connecting sectors, between which the storeys 3 are connected by passages 6. As the sequence continues, the passages 6 between the ring-shaped buildings R3 and R4 are located in the region of the sectors 1*b*, before the connecting passages between the ring-shaped buildings R4 to R6 and back to R1 repeat between the mutually opposite sectors 1*f*, 1*d* and 1*b*. There is always one sector 1 between the two connecting sectors of a ring-shaped building R. In the case of the ring-shaped building R1, the sector 1*a* is located between the connecting sectors 1*b* and 1*f*.

The exemplary embodiment of FIG. 4 shows a building complex consisting of ring-shaped buildings R comprising a polygon ring with five vertices, which requires said ring-shaped buildings R to be arranged in a decagon, wherein once again the ring-shaped buildings R must in each case be arranged in an alternating fashion offset through an angle of 180° relative to one another. Using terminology analogous to the exemplary embodiment shown in FIGS. 1 and 2, assuming a storey offset which ascends in the clockwise direction, the connecting sectors 1*b* result between the ring-shaped buildings R1 and R2 and the connecting sectors 1*e* result between the ring-shaped buildings R2 and R3. Since all the other adjacent pairs of ring-shaped buildings R are also located opposite one another with connecting sectors which have a corresponding storey offset, all the ring-shaped buildings R1 to R10 can be joined together by passages 6 to form a ring of buildings.

Although ring-shaped buildings comprising a polygon ring with six or five vertices are usually used, the invention is not limited to these numbers of vertices. Since the connecting sectors of the ring-shaped buildings must always be perpendicular to the polygon side between the ring-shaped buildings to be connected, so that the passages 6 between the connecting sectors run in the direction of this polygon side, the angle between the two connecting sectors corresponds to the angle between two polygon sides, which in turn has the result that, in the case of an even-numbered polygon ring of the ring-shaped buildings, there must be between the connecting sectors a number $Z_g$ of sectors which corresponds to half the number of vertices $E_g$ of the polygon ring minus 2: $Z_g=E_g/2-2$. In the case of an odd number of vertices $E_u$ of the polygon ring, there must be between the two connecting sectors of a ring-shaped building a number $Z_u$ of sectors which corresponds to half the number of vertices $E_u$ plus one, minus two: $Z_u=(E_u+1)/2-2$.

The invention claimed is:

1. A building complex comprising multi-storey ring-shaped buildings (R) having sectors (1) which are trapezoidal in plan view, form a regular polygon ring and enclose a courtyard having a central stairwell (4), the storeys (3) of said sectors being uniformly offset from one another in the height direction and being connected to the stairwell (4) by passages (5) which run in a spoke-like fashion, said stairwell having a staircase which circulates in the direction of ascent of the storeys and which has a height of ascent (a) between the passages (5) corresponding to the storey offset (h), wherein, in the case of ring-shaped buildings (R) comprising an even-numbered polygon ring, the mutually identical ring-shaped buildings (R) are arranged at the vertices of a polygon corresponding to the polygon ring and, in the case of ring-shaped buildings (R) comprising an odd-numbered polygon ring, said ring-shaped buildings are arranged in an alternating fashion, in each case offset through an angle of 180°, at the vertices of a polygon having twice the number of vertices, and wherein the ring-shaped buildings (R) following one another along the polygon are connected by passages (6) which run between the storeys (3) of mutually opposite connecting said sectors with a corresponding storey offset, wherein, between two connecting said sectors (1) of each ring-shaped building (R), there is a number of said sectors (1) that, in the case where the polygon ring is the even-numbered polygon ring, corresponds to half the number of vertices minus two, and, in the case where the polygon ring is the odd-numbered polygon ring, corresponds to half the number of vertices plus one, minus two.

2. The building complex according to claim 1, wherein the ring-shaped buildings (R) form a regular hexagon and are arranged at vertices of a hexagon.

3. The building complex according to claim 1, wherein the ring-shaped buildings (R) form a regular pentagon and are arranged at vertices of a decagon.

4. A building complex comprising:

a plurality of buildings each having generally a ring shape of a regular polygon having E sides that is the same for all of the buildings enclosing a respective courtyard having a respective central stairwell;

each of said buildings comprising sectors that are each trapezoidal when viewed from above;

the sectors each having respective storeys that are uniformly offset from one another by a storey offset in an ascent direction and that are connected to the stairwell by passages that extend generally radially thereto;

said stairwells each having a staircase that extends in the ascent direction of the storeys and has a height of ascent between the passages corresponding to the storey offset;

wherein, when the number E of sides is an even number, the buildings are arranged at vertices of a larger polygon having E sides, and wherein, when the number E of sides is an odd number, the buildings are arranged at vertices of a larger polygon having 2 E sides, with the buildings each being rotatively offset by an angle of 180° relative to adjacent one of the buildings around the larger polygon;

wherein the buildings adjacent each other along the larger polygon are each positioned so that two of the sectors thereof face respective sectors of the adjacent buildings, and said sectors are connected by passages that run between the storeys of the sectors of the adjacent buildings with a storey offset that corresponds to the storey offset of the storeys connected by the passages;

wherein the two of the sectors of each building that connect via said passages to the sectors of the adjacent buildings are located such that between the two of the sectors of each building, there is a number (E/2)−2 of the sectors where E is an even number, and a number (E+I)/2−2 of the sectors where E is an odd-numbered polygon ring corresponds to half the number of vertices plus one, minus two.

5. The building complex according to claim 4, wherein the buildings each have the shape of a regular hexagon and are arranged at vertices of a hexagon.

6. The building complex according to claim 4, wherein the buildings each have the shape of a regular pentagon and are arranged at vertices of a decagon.

* * * * *